US005357143A

United States Patent [19]

Lehr et al.

[11] Patent Number: 5,357,143

[45] Date of Patent: Oct. 18, 1994

[54] ELECTRONIC DOOR LOCKING MECHANISM

[76] Inventors: David D. Lehr, 7430 Eagle Dr., Lincoln, Nebr. 68507; Daniel S. Lehr, 6416 Francis St., Lincoln, Nebr. 68505

[21] Appl. No.: 101,897

[22] Filed: Aug. 2, 1993

[51] Int. Cl.[5] ..... E05F 15/18

[52] U.S. Cl. ..... 307/10.1

[58] Field of Search ..... 70/263-264, 70/262, 265-268; 307/10.1, 10.2, 9.1; 180/287, 289

[56] References Cited

U.S. PATENT DOCUMENTS

| | | | |
|---|---|---|---|
| 2,506,851 | 5/1950 | Ayers, Jr. | 70/264 |
| 2,530,628 | 11/1950 | Pivero | 292/33 |
| 2,765,648 | 10/1956 | Hatcher | 70/264 |
| 2,974,742 | 3/1961 | Tyler | 180/82 |
| 3,754,164 | 8/1973 | Zorzy | 317/134 |
| 4,013,930 | 3/1977 | Geller | 361/172 |
| 4,083,424 | 4/1978 | von den Stemmen et al. | 180/114 |
| 4,537,049 | 8/1985 | Lupoli | 70/277 |
| 4,612,729 | 9/1986 | Sato | 49/362 |
| 4,730,120 | 3/1988 | Okada | 307/10 AT |

*Primary Examiner*—A. D. Pellinen
*Assistant Examiner*—Aditya Krishnan
*Attorney, Agent, or Firm*—Zarley, McKee, Thomte, Voorhees & Sease

[57] ABSTRACT

The conventional door lock on a bulkhead door of a delivery van or the like is controlled by an electrical circuit including a solenoid which is activated by a time delay relay circuit operatively connected to the vehicle ignition. When the vehicle is being operated, the lock maintains the door in a locked position. When the vehicle stops and the operator removes the key from the ignition, the circuitry of the invention momentarily unlocks the door lock which enables the operator to manually slide the door open without the necessity of using the key to unlock the door. After a few seconds, the circuit deactivates the solenoid so that the lock will relock automatically.

4 Claims, 3 Drawing Sheets

ELECTRONIC DOOR LOCKING MECHANISM

BACKGROUND OF THE INVENTION

The present invention relates generally to locks and locking devices and more specifically to electronic and timer actuated door locking devices for use in a delivery van or the like.

Electrically operated door locks for vehicles are common and are well known in the art. Many operate by the principal of locking all doors on the vehicle from a single point such as a door switch. Some use a pulse circuit in which the closing of all the doors completes the circuit thereby locking all the doors. There are also examples of electronic combination locks located on the front dashboard of a vehicle to control a lockbolt on the back of the vehicle. Timers are also utilized to relock the lockbolt if it has not opened within a given time interval and to lock the door after it has been shut.

In mail delivery and cargo trucks, the driver is continually leaving the truck to deliver packages and other items to customers. This results in a security problem in that drivers must continuously lock and unlock the bulkhead door located between the driver's compartment and the cargo storage area. For example, when the driver reaches a delivery point, the driver must open the locked cargo area with his/her key, remove the delivery package, and relock the cargo door. This is very tedious and time consuming and experience has shown that drivers often inadvertently leave the cargo area unlocked exposing the cargo to pilferage.

None of the previously described locking devices include a mechanism which solves this security problem. The electronic door locking mechanism of this invention automatically unlocks the bulkhead door on the cargo truck or delivery van when the ignition is turned off, and then relocks the lock automatically after a given time interval. This eliminates the necessity of keys for locking and unlocking the cargo door and prevents any problems of inadvertently leaving the cargo door unlocked.

SUMMARY OF THE INVENTION

An electrical door locking apparatus is described for use in locking and unlocking a bulkhead door of a delivery truck or the like. The bulkhead door includes a conventional lock and lockbolt mechanism capable of being moved between a locked and unlocked position. The bulkhead door lock may be either opened by a conventional key or by the electrical circuitry of this invention which is electrically connected to the vehicle ignition switch. When the vehicle ignition switch is turned off, the lock on the bulkhead door is opened for a predetermined length of time to enable the driver to enter the cargo area without the necessity of using a key in the lock of the bulkhead door. After a predetermined amount of time has elapsed, the locking mechanism moves to its closed position so that when the bulkhead door is closed as the driver exists the cargo area, the bulkhead door will be automatically locked.

The disadvantage and problems of the prior art are solved by the present invention which provides for a novel and improved electronic door locking mechanism for a sliding or other type door, which is easily operated and very secure.

With this in mind, it is the primary object of the present invention to provide an electronic lock for a bulkhead door for added security which is operatively controlled by the vehicle's ignition.

Another object of the invention is to provide an electronic lock for a cargo compartment door which automatically unlocks when the vehicle ignition is deactivated.

Yet another object of the present invention is to provide an electronic locking system that does not require the driver to remember to lock the bulkhead door.

Still another object of the invention is to provide an electronic lock that automatically relocks itself in a short time after being unlocked.

Yet another object of the invention is to provide a lock which doesn't require a key to activate it.

And still another object of the present invention is to provide a lock which locks and unlocks in response to a timing device.

These and other objects of the present invention will be apparent to those skilled in the art.

DETAILED DESCRIPTION OF THE PREFERRED EMBODIMENT

Figure 1:
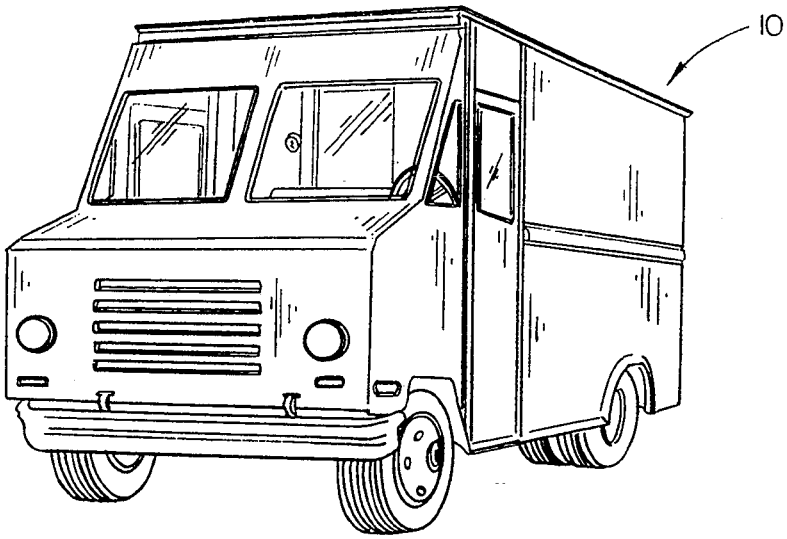
FIG. 1 is a front perspective view of a typical delivery truck.
Figure 2:
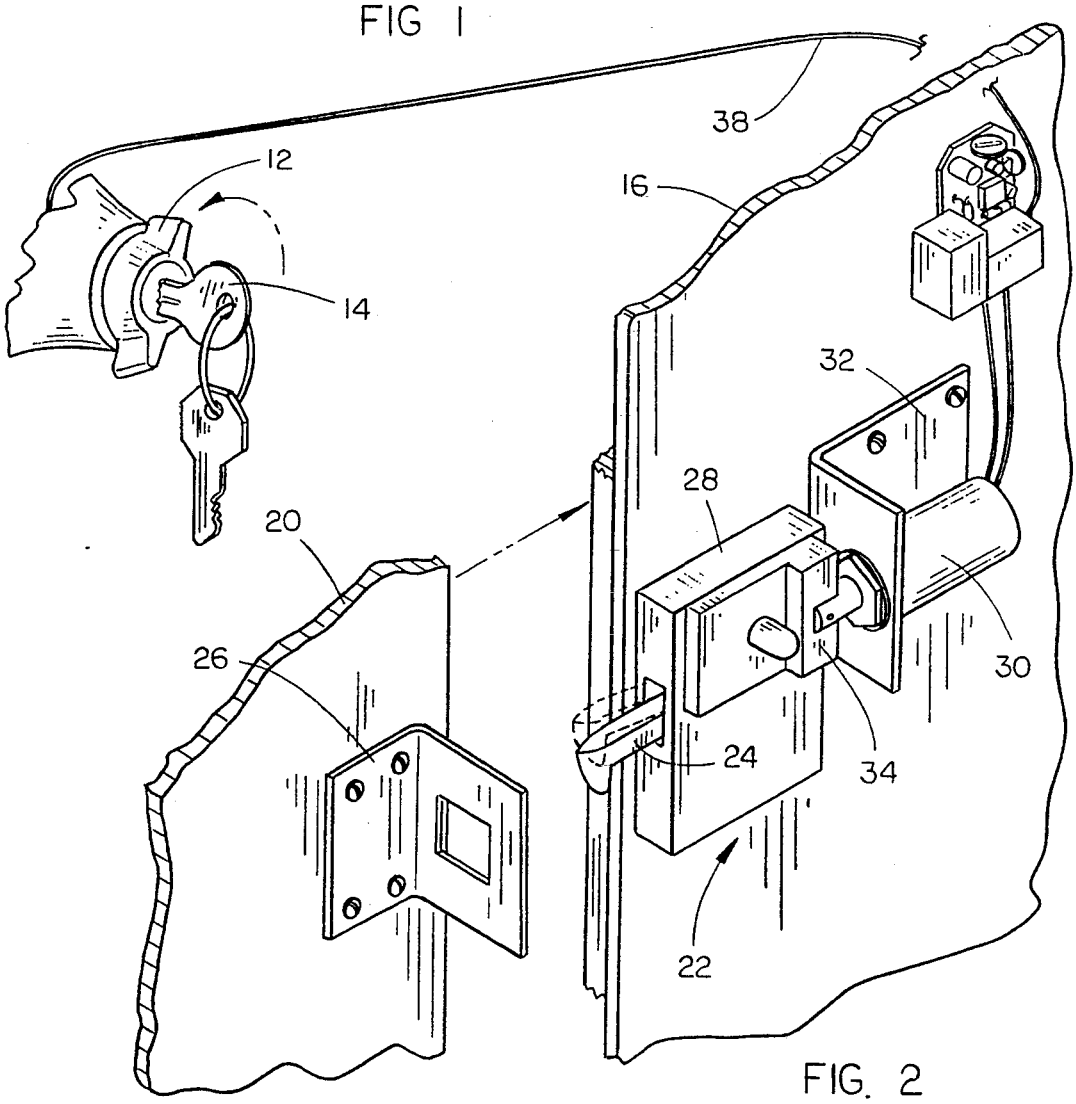
FIG. 2 is a partial perspective view of the vehicle ignition and the door locking device.
Figure 3:
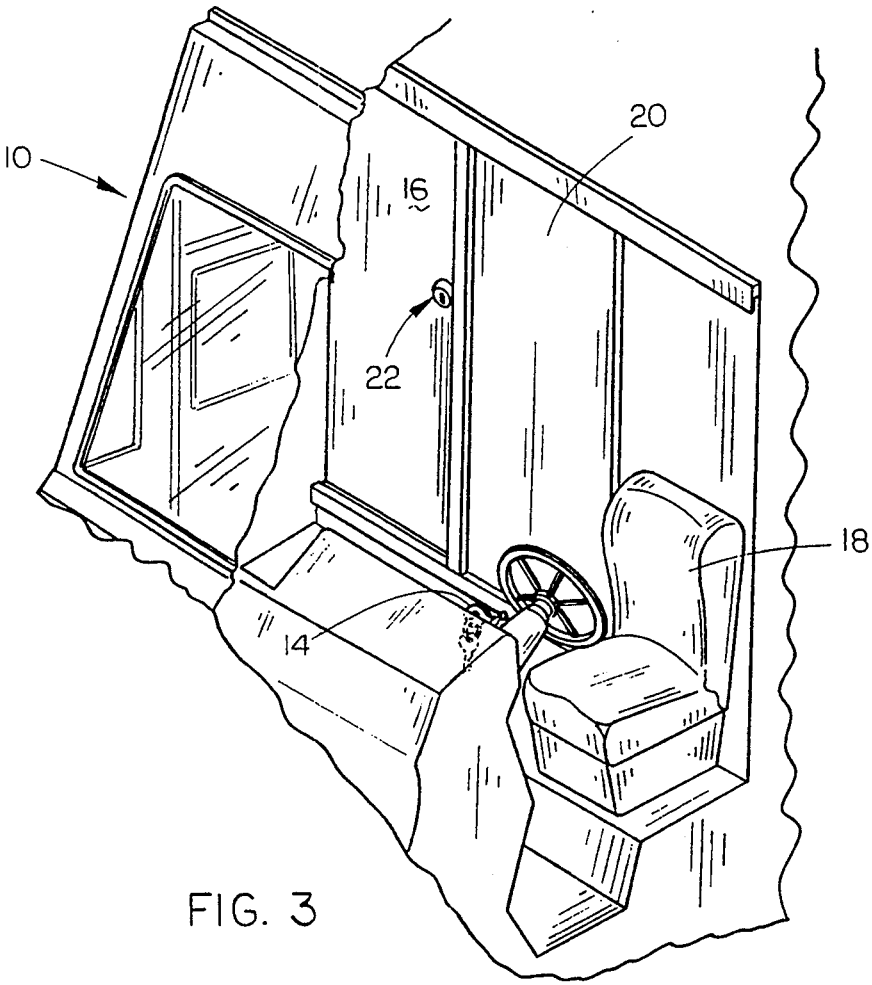
FIG. 3 is a partial perspective view of the driver's cab of the delivery truck and the bulkhead door.
Figure 4:
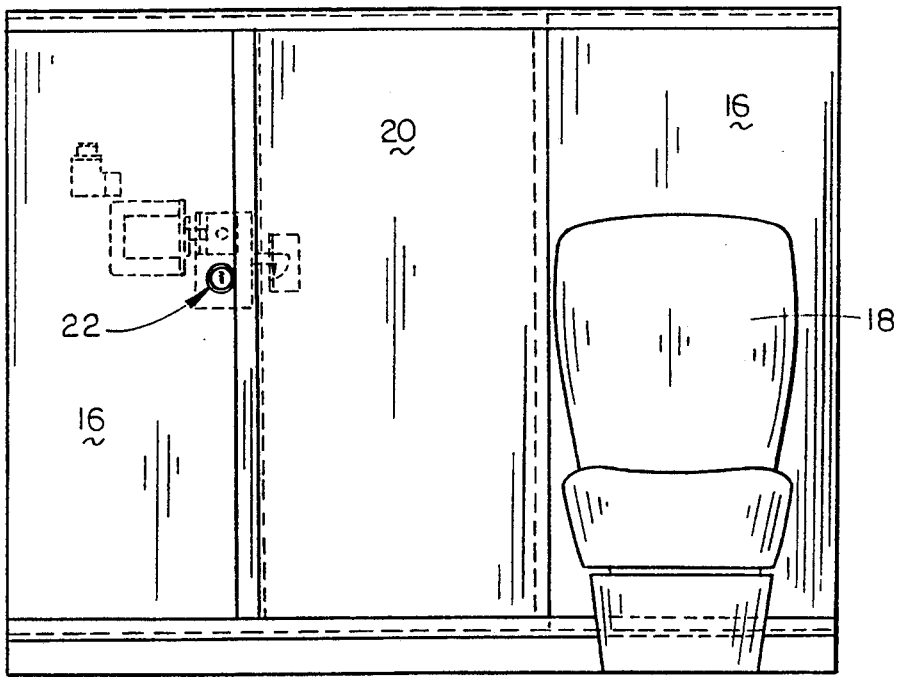
FIG. 4 is a partial front elevational view of the driver's cab of the vehicle and the bulkhead door.
Figure 5:
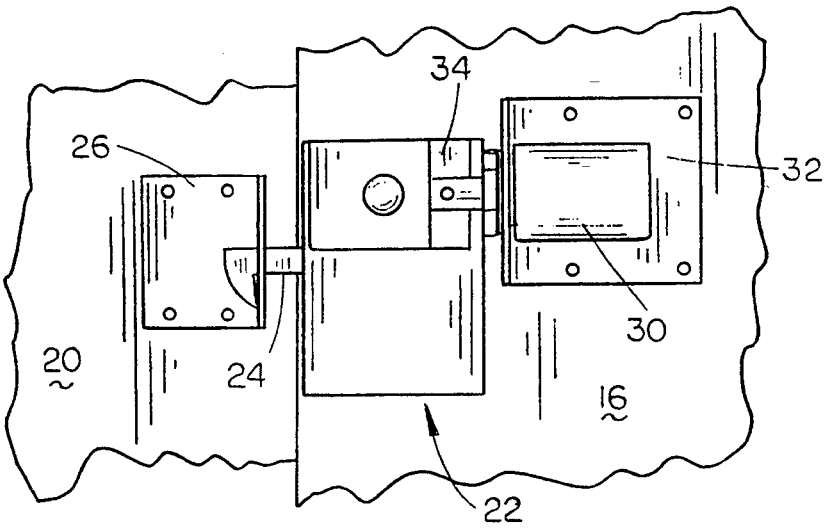
FIG. 5 is a rear view of the electronic lock of this invention in the locked position.
Figure 6:
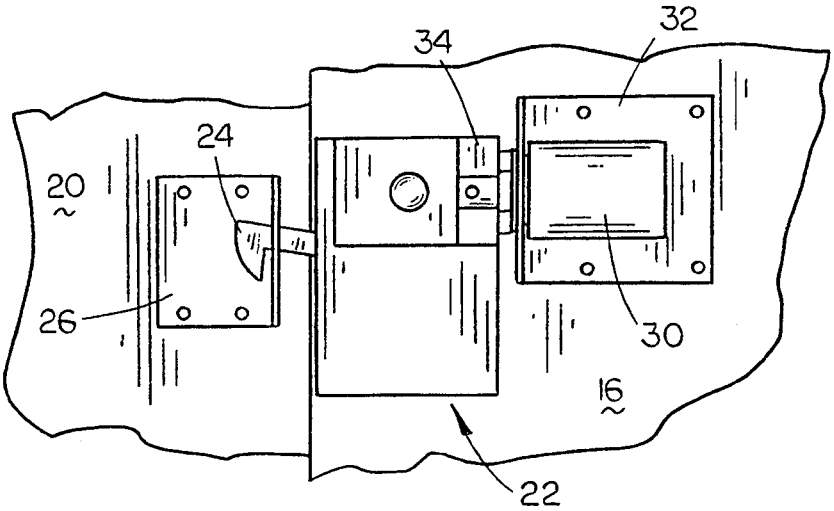
FIG. 6 is a rear view of the electronic lock of this invention in the unlocked position.

With reference to FIG. 1, the numeral 10 refers to a typical delivery truck or vehicle. As seen in FIG. 2, the vehicle 10 includes a conventional normally opened ignition switch 12 which is operated by key 14 in conventional fashion.

Vehicle 10 includes a bulkhead 16 which separates the driver's cab 18 from the cargo storage area in the vehicle. Bulkhead door 20 is slidably mounted in bulkhead 16 and includes a conventional lock 22 normally used to lock the door 20. Lock 22 includes locking arm 24 which is adapted to be received by the receiver 26. As seen in FIG. 2, receiver 26 is mounted on the rearward side of door 20. Locking arm 24 is pivotally mounted in a conventional housing 28 positioned on the rearward side of bulkhead 16.

Normally, locking lever 24 is moved to its unlocking condition by means of a suitable key which is inserted into the lock 22. It is to this structure that the electrical locking mechanism of this invention is connected to enable the locking arm 24 to be moved to its unlocked position for a brief period of time after the vehicle ignition switch 12 is turned off.

As seen in FIG. 2, a solenoid 30 is mounted on a bracket 32 which is secured to the rearward side of bulkhead 16. The solenoid 30 is operatively connected to the locking arm 24 through the linkage 32 so that locking arm 24 is moved to the unlocked position illustrated by broken lines in FIG. 2 when the solenoid 30 is actuated as will be described in more detail hereinafter.

Figure 7:
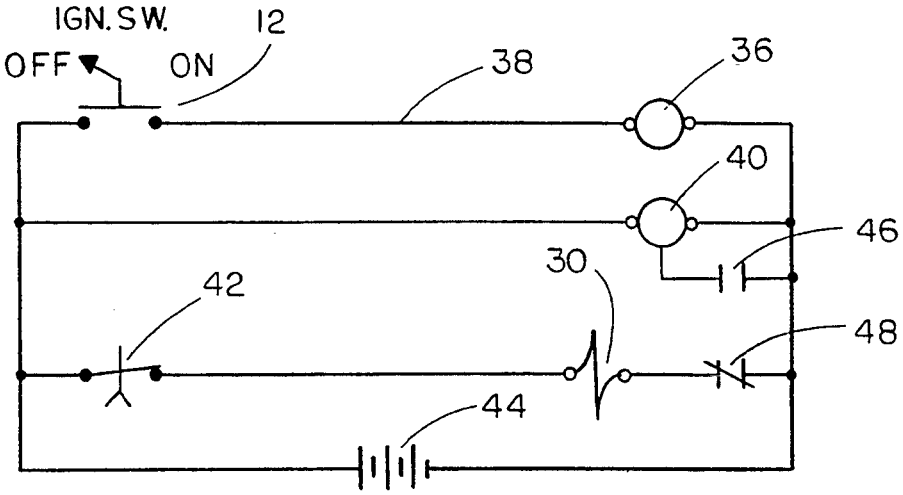
FIG. 7 is a schematic diagram of the door locking circuit according to the present invention.

Referring to the schematic of FIG. 7, it can be seen that the ignition switch 12 is electrically connected to a control relay 36, by lead 38, including a normally open interlock 46 and a normally closed interlock 48. The numeral 40 refers to a time delay relay while the numeral 42 refers to the time delay interlock of time delay relay 40. The numeral 44 refers to the battery of the vehicle.

When the ignition switch 12 closes (on), relay 36 is enabled. Relay 36 then sets the timer 40 and opens the solenoid circuit. When the ignition switch opens (off), relay 36 is disabled which closes the solenoid circuit until timer 40 opens after a prescribed time delay.

When the ignition switch is on, the solenoid 30 is not activated since the solenoid circuit is opened as previously described. In this condition, locking arm 24 is in its locked condition to maintain the door 20 in its closed locked position. When the driver arrives at a delivery point or location, the ignition switch 12 is turned off thereby disabling relay 36 which closes the solenoid circuit to actuate solenoid 30 for a prescribed period of time until the timer 40 is opened. When the solenoid circuit is closed upon the ignition switch 12 being turned off, solenoid 30 operates the linkage 34 so that locking arm 24 is moved to its unlocked position as illustrated by broken lines in FIG. 2. Thus, the driver of the vehicle may then simply slide door 20 open without the necessity of inserting a key into the locking mechanism 22. The solenoid circuit is closed for a predetermined length of time and is then opened after that time has elapsed. Thus, the driver can close the door 20 upon leaving the cargo area knowing that the locking arm 24 will be again moved to its locked position to maintain the door 20 in its locked condition.

Thus it can be seen that a novel mechanism has been provided for automatically unlocking the bulkhead door when the driver switches off the ignition switch. As stated, the driver may then enter the cargo storage area without the necessity of utilizing a key to gain access thereto. When the driver leaves the cargo storage area, the door is manually slidably closed with the door being maintained in its locked condition.

Thus it can be seen that the invention accomplishes at least all of its stated objectives.

We claim:

1. A vehicle including a driver's station separated from a cargo storage area by a bulkhead having a door mounted therein, said door including a key-operated door locking mechanism for locking and unlocking the door, said vehicle including an ignition switch which is movable between on and off positions, and an electrical circuit means operatively connecting said ignition switch and said door locking mechanism which unlocks said door locking mechanism for a predetermined length of time after said ignition switch has been moved from its on position to its off position.

2. The combination of claim 1 wherein said electrical circuit means automatically locks said door locking mechanism after said predetermined length of time has elapsed.

3. In combination with a vehicle including a driver's station separated from a cargo storage area by a bulkhead having a door mounted therein, said door including a key-operated door locking mechanism for locking and unlocking the door, said vehicle including an ignition switch which is movable between on and off positions, and an electrical circuit means operatively connecting said ignition switch and said door locking mechanism which unlocks said door locking mechanism for a predetermined length of time after said ignition switch has been moved from its on position to its off position.

4. The combination of claim 3 wherein said electrical circuit means automatically locks said door locking mechanism after said predetermined length of time has elapsed.

* * * * *